United States Patent [19]

Byers et al.

[11] Patent Number: 4,616,465

[45] Date of Patent: Oct. 14, 1986

[54] STORAGE VESSEL AND METHOD OF ASSEMBLY

[75] Inventors: Stuart D. Byers; John F. Clark, both of Mississauga, Canada

[73] Assignee: Crophandling Systems Limited, Mississauga, Canada

[21] Appl. No.: 635,049

[22] Filed: Jul. 27, 1984

[30] Foreign Application Priority Data

Mar. 22, 1983 [CA] Canada ..... 1,193,821

Related U.S. Application Data

[63] Continuation-in-part of Ser. No. 516,987, Jul. 25, 1983.

[51] Int. Cl.[4] ..... E04B 1/32; B65D 90/02

[52] U.S. Cl. ..... 52/748; 52/245; 52/543

[58] Field of Search ..... 52/741–743, 52/745–748, 584, 543, 542, 518, 506, 269, 265, 261, 249, 245, 192–197, 80, 348, 349

[56] References Cited

U.S. PATENT DOCUMENTS

| | | | |
|---|---|---|---|
| 737,078 | 8/1903 | Chapman | 52/519 |
| 1,718,519 | 6/1929 | Bayley | 52/193 |
| 2,235,937 | 3/1941 | Linberg | 52/741 |
| 2,691,959 | 10/1954 | Dueringer et al. | 52/194 |
| 3,460,307 | 8/1969 | Faerber | 52/741 |
| 4,067,097 | 1/1978 | Okamato | 52/745 |
| 4,112,644 | 9/1978 | Allen | 52/245 |
| 4,197,689 | 4/1980 | Demuth | 52/245 |

FOREIGN PATENT DOCUMENTS

| | | | |
|---|---|---|---|
| 495/26 | 2/1926 | Australia | 52/195 |
| 733248 | 5/1966 | Canada | 52/197 |
| 2212205 | 10/1973 | Fed. Rep. of Germany | 52/745 |

*Primary Examiner*—John E. Murtagh
*Assistant Examiner*—Andrew Joseph Rudy
*Attorney, Agent, or Firm*—Donald E. Hewson

[57] ABSTRACT

A storage tank, such as a water tower is disclosed, made by bolting rows of glass-coated steel plates together. The plates overlap each other side to side and above and below. The contact with plates at the diagonal corners is not an overlapping contact but an abutment contact, and the lines of abutment contact are staggered row to row. This arrangement leads to a very efficient use of material, and to an inherently leak proof structure when the plates are arranged to form a double skin in the lower regions of the tower.

5 Claims, 7 Drawing Figures

STORAGE VESSEL AND METHOD OF ASSEMBLY

RELATED APPLICATION

This application is a continuation-in-part application of application Ser. No. 516,987, filed July 25, 1983 now pending in 756 4-4-86.

This invention relates to bulk storage vessels, particularly to water storage tanks or towers.

BACKGROUND TO THE INVENTION

It is common practice to make water tanks, or towers, from sheet steel plates. However, to construct a very tall tower where there are significant hydraulic pressures in the lower part of the tower, it has been the usual case to make the tower double-skinned at the bottom. Hitherto it has been practicable to make a double-skinned tower only if the tower is of welded construction. Welding is very expensive however since skilled operators are required, and the need to stress-relieve the welds poses further limitations.

One of the problems with bolting plates together is that the ends of the bolts protrude. The tower constructor cannot simply bolt a set of plates to encircle an existing set: the plates must be interleaved together if he wishes to provide an effective double-skinning arrangement by bolting.

An advantage of bolting is that the plates can be pre-finished. Glass-coating the steel is a very effective protection for water storage tanks: the glass coating is applied to both sides of the plates and provides a very hard inert barrier (about 0.008 inches thick) of silica glass, which is chemically and mechanically bonded to the steel.

Another problem though with bolting is that not all the edges of the plates can be overlapped and bolted tightly together. Not, at least, if the overlapping is to occupy only a margin at the edge of the plates, and also not if a gap or space between the plates is to be avoided. A further problem is that where the edges of the plates are in abutment, a potential leakpath arises, which must be accounted for.

PRIOR ART

In the prior art, U.S. Pat. No. 3,861,552 ADAMS (Jan. 21, 1975) shows a welded tower with a double skin at the bottom. U.S. Pat. Nos. 2,953,276 DUNN (Sept. 20, 1960), 4,188,759 LIET (Feb. 19, 1980), and 4,197,689 DEMUTH (Apr. 15, 1980) all show bolted towers, but as mentioned above, none show how it might be possible to impart a double-skinned arrangement at the bottom of the tower. Also, flanges as shown for bolting the plates together cannot serve in a double-skinned arrangement. A tower with a single-skinned arrangement over its whole height is shown in U.S. Pat. No. 2,729,313 (ERNESTUS, 03 Jan. 1956).

BRIEF DESCRIPTION OF THE INVENTION

The invention provides a storage vessel or tower, such as a tall water tank, with a double skin at the bottom. It provides the double skin with a minimum of extra plate thicknesses. (Triple and quadruple thickness is inevitable at some of the joints). The invention also provides a long length of abutment where abutment is necessary between the plates; the longer the length the easier it is to provide an inherently reliable seal against high hydrostatic water pressures.

The invention does this by staggering the plates and abutting them over the overlapped length, as will be explained in more detail hereafter. A plate overlaps the plates directly alongside and directly above and below; and the plate also abuts, but does not overlap, the plates which are diagonal relative to it. In the usual mode of assembly, as practised by this invention, it is the plates is the plates in the relatively top right and bottom left positions, as viewed from the outside of the tower, that are overlapped. Of course, the opposite mode of overlap may also be practised, without departing from the present invention, so long as the direction of overlapping is consistent in all levels of plate as they are assembled.

By adjusting the degree of vertical overlap, a single or a double skin may be provided: the abutment lengths in the double-skinned part may be long for inherent protection against leaks; there are no vertical spaces or voids present between any overlapping plates; and only a minimum of triple and quadruple thicknesses need be provided. We have discovered that there is an arrangement of overlapping and abutting the plates that leads to the stated benefits. Most attempts to achieve double skinning are found to have one or other of the problems that are avoided by the present invention.

The way in which these advantages are provided for by the invention will become apparent from the description below of a specific embodiment of the invention.

It is convenient for the plates of the water tower to be all the same size and shape. The holes for the bolts, of course, must be formed before the plate is given its glass coating. Apart from that restriction, there is no difficulty in providing plates with different patterns of holes one to another. In any event, it will be evident to the skilled practioner that the holes in the plates are normally punched using trapezoidal punching patterns, where the rows of holes on the vertical edges of each plate are not parallel but the rows are slightly wider apart at the top than at the bottom—they slope outwardly—and where the distance between holes in the top margin is slightly greater than in the bottom margin; all so as to accommodate the overlap of plates and so as to maintain a constant diameter of the tower as it is assembled. Also, the plates may be of different thicknesses, with the thickest at the bottom, gradually reducing in thickness until only a single skin is needed, then the single skin too may be of reducing thickness up to the top of the tower. The plates are preferably curved to the profile of the tower.

An exemplary embodiment of the invention will now be described with reference to the accompanying drawings.

DESCRIPTION OF THE PREFERRED EMBODIMENTS

Figure 1:
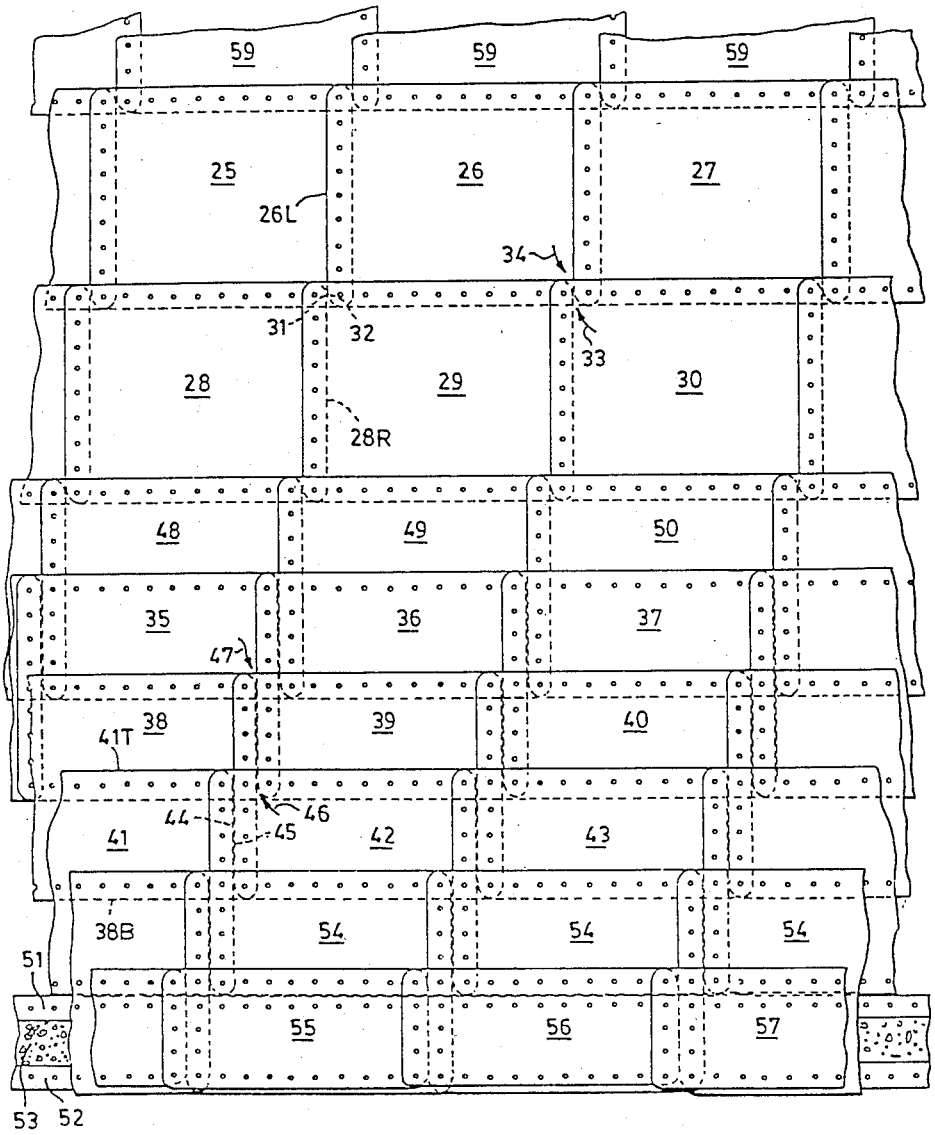
FIG. 1 shows a side elevation of part of a cylindrical water tower made of plates.
Figure 2:
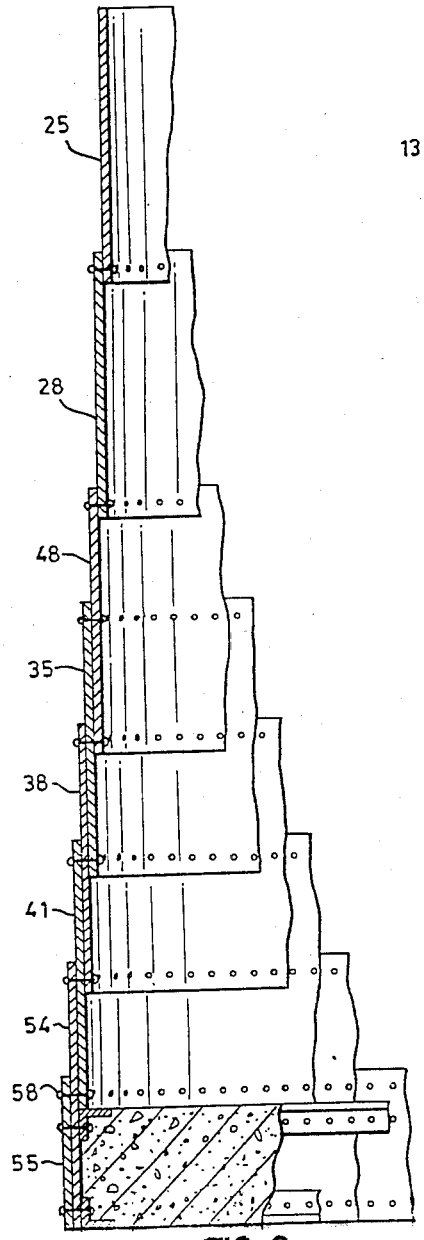
FIG. 2 is a section through part of the tower of FIG. 1.

The plates that make up the tower are placed in the abutting and overlapping relationship that is shown in FIGS. 1 and 2.

The plates shown are all the same rectangular shape and size. The dispositions of holes formed in the plates, however, are not all the same. In the following discussion, which relates to the drawings showing plates and assembly of plates as illustrated, it will be understood the designations "left" and "right" can be read in reverse; i.e., "right" and "left", whereby the plates and assembly of plates would be substantially the mirror image of that which is illustrated.

Figure 3:
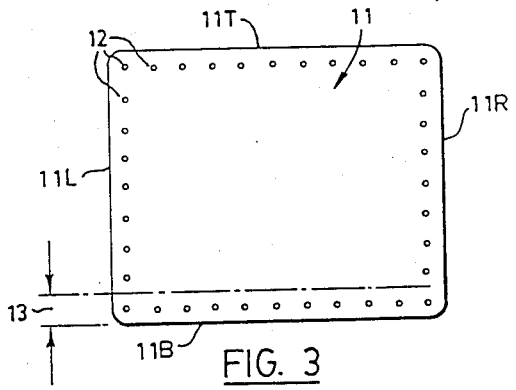
FIGS. 3, 4 and 5 are elevations of plates used in the tower of FIG. 1

FIG. 3 shows a plate 11 of a set of plates termed the singles set. The plate 11 has a respective margin contiguous with its top 11T, bottom 11B, left hand side 11L, and right hand side 11R, edges. Regularly pitched bolt holes 12 are disposed in these margins. Normal engineering practice provides that a bolt hole should be positioned in from the edge of a plate by a distance that is no less than the diameter of the hole, and that practice is followed here. The margin is the area which comes under the direct action of bolts placed in the holes, and thus may be regarded as extending from the appropriate edge of the plate a distance inwards some two or three times the diamter of the hole. The width of a margin is typically of the proportions shown in FIG. 3 at 13.

Figure 4:
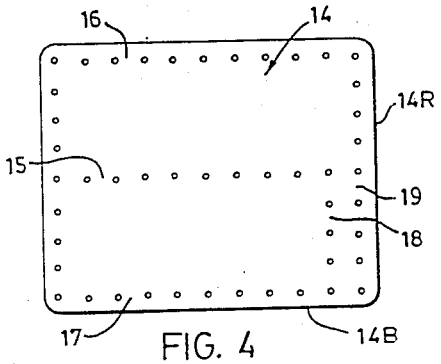

FIG. 4 shows a plate 14 of a set of plates termed the transition set. The plate 14 has holes in the margin, like the plate 11. In addition, the plate 14 has a middle row 15 of holes disposed midway between the top 16 and bottom 17 rows of holes. Also, the plate 14 has a column 18 of holes disposed adjacent to and parallel to the holes 19 in the margin contiguous with the right hand edge 14R, the column 18 of holes extending from the middle row 15 down to the row 17 of holes in the margin contiguous with the bottom edge 14B.

Figure 5:
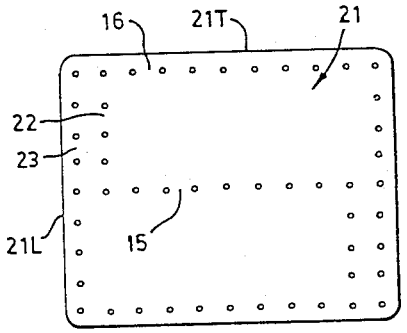

FIG. 5 shows a plate 21 of a set of plates termed the doubles set. The plate 21 has all the holes of a plate 14 of the transition set, and in addition it has a column 22 of holes disposed adjacent to and parallel to the holes 23 in the left hand margin 21L, the column 22 of holes extending from the row 16 of holes in the top margin 21T down to the middle row 15.

Returning to FIGS. 1 and 2, a row of plates 25, 26, 27 . . . forms a complete ring or band, several of these rings being required to build the whole tower. The plates 25, 26, 27 . . . are from the singles set, as are the plates 28, 29, 30 . . . in the row below. The plates forming one of the rows are in simple overlapping relationship; that is, the right hand margin of one plate 28 just, and only just, covers the left hand margin of the next plate 29. The two plates 28, 29 directly overlap each other, in that they are in actual contact (apart from a jointing compound placed in the contact area) and there is no other plate between them.

Similarly, a plate 28 directly overlaps the plate 25 above it, but now the bottom margin of the plate 25 is staggered with respect to the top margin of the plate 28. A top portion 31 of the right hand edge 28R of the plate 28 is, because of the extent of the stagger, in direct edge to edge abutment with a bottom portion 32 of the left hand side edge 26L of the plate 26. It can be seen that the height of the direct overlap between the plates 25 and 28, and also, and as a consequence, the heights of the top 31 and bottom 32 portions, are equal to the width 13 of the margin.

It will be noted that all of the overlapped joints can be made tight by careful tightening of the bolts through the appropriate holes. However, the abutment between the portions 31 and 32 is a potential leakpath, that cannot be sealed by tightening the bolts. Such a potential leakpath is indicated by the arrows 33, 34 in FIG. 1. If the jointing compound that seals the leakpath 33, 34 should fail, the joint would leak and it could be quite difficult to repair it. On the other hand, at the top of the tank, as indicated, the water pressure is quite low, and the tendency therefore is only slight for the water to extrude compound out of the leakpath 33, 34, even if the compound deteriorates.

Further down the tank, the water pressure is higher and a leakpath such as that shown at 33, 34 becomes increasingly more prone to failure. In addition, of course, further down the tank the higher pressure means that the stresses in the plates become higher.

Thus, the lower part of the tank has a double skin, with the long abutment feature that is made possible by the present invention, and that provides an inherently leakproof structure.

The plates 35, 36, 37 . . . are from the doubles set, as are the plates 38, 39, 40 . . . in the row below, and the plates 41, 42, 43, . . . in the row below that.

The plates in any one row, such as the plates 35, 36, 37, . . . are in direct overlapping relationship, in that the left hand margin of one plate 36 just, and only just, covers the right hand margin of the next plate 35. Similarly, a plate 41 directly overlaps the plate 38 above it, but now the overlapping portion is much greater than simply the width of the margin, in that the area of the overlap between the plates 41 and 38 extends from the top edge 41T to the bottom edge 38B, a distance equal to half the height of the plates, plus the width of a margin, as may be seen in FIG. 1.

Now, the height of the direct overlap between the plates 41 and 38 determines also the height of the top 44 and bottom 45 portions of the edges of the respective plates 41 and 39 that are in direct edge-to-edge abutment with each other, so that the left hand edge of the plate 39 and the right hand edge of the plate 41 abut each other over a length of half the height of a plate plus the width of a margin.

Since this same degree of overlap is present between the plate 38 and the plate 35 above it, the bottom margin of plate 35 overlaps the top margin of the plate 41, the overlap having a height equal to the width of a margin. It should be noted that this overlap is only indirect in that, of course, the plate 38 passes between, and separates, the plates 35 and 41.

The effect of this double overlapping, coupled with the staggering of the plates row-to-row, is that the potential leakpath at the abutment is very long. The potential leakpath is indicated by the arrows 46, 47 in FIG. 1. Not even the most deteriorated compound will tend to extrude through a path that long, under the available water pressure. The leakpath may be made longer still by forming the abutting (vertical) edges of the plates in a jogged or sawtooth manner.

The plates 48, 49, 50, . . . are from the transitional set, and there is only one row of those plates. The manner in which the plates 48, 49, 50, . . . provide a transition between the plates 28, 29, 30, . . . and the plates 35, 36, 37, . . . may be easily inferred from FIG 1.

The construction of the tower, including the assembly of plates having various overlapping or surface-to-surface contacts as discussed above, is more fully understood with reference to the following description of the method of erecting the tower.

Following the placement of footings and anchor bolts, at a sufficient depth in the ground as may be determined by local conditions—the footings and anchor bolts are not shown—the foundation ring or base ring of plates 54 is assembled, leveled and made round. Rounded angles 51 and 52 are assembled to the base ring plates 54, the lower rolled angles 51 are secured to the anchor bolts, and a concrete foundation plinth 53 is cast, up to the level of the top of rolled angle 52. The concrete is then left to cure, for a period of three to twenty eight days, and it is the usual case that further construction does not continue until after twenty eight days, by which time the concrete has fully set up. However, because the concrete may have shrunk to some extent as it has cured, it is usual that hollow bolts are used to secure the rolled angle 51 to the base ring plates 54, so that additional mastic may be pumped or extruded to the hollow bolts against the concrete in any voids that may then exist. At the same time, the reinforcing plates 55, 56, 57, . . . are put into place, and they may extend substantially to the bottom of the plinth as shown, or they may extend only part way down the plinth from the top, provided that they extent above the level of the plinth for bolting into the row of holes at the level 58.

After the concrete of the plinth has cured, a row of plates 25, 26, 27, . . . is assembled and formed into a ring by overlapping the edges and bolting them together. At this time, the roof having plates 59 may also be assembled, or it may be that the row of plates 25, 26, 27, . . . comprises the top of the tank and that no other plates or roof structure may be assembled. In any event, after the plates 25, 26, 27, . . . are formed into a ring, conventional lifting jacks such as mechanical or hydraulic lifting jacks as are well known in the industry (not shown) raise the ring until plates 28, 29, 30, . . . can be brought into place on the plinth 53 and fitted to the plates 25, 26, 27, . . . in the manner shown in FIG. 1, both as to vertical height, and as to orientation to achieve the staggered effect as described above.

More rings are added, by jacking up the already assembled rings, again using conventional jacks, and fixing the new rings underneath, until the tower is as high as desired. The rings at the bottom are double-overlapped to provide the benefits of the invention as described.

As can be seen from FIGS. 1 and 2, the plates 41, 42, 43, . . . are the last or tie-in ring to be placed. However, the base ring which comprises plates 54 is not reinforced by a double skin just at the bottom of the tie ring 41, 42, 43, . . . ; and therefore, the reinforcing belt comprising the half- or smaller-sized plates 55, 56, 57, . . . is in place to provide the additional skin thickness as required at the bottom of the tower.

There has been described a water tower or other storage structure that may be made from a plurality of preformed sheets of steel, and which may be bolted (or otherwise fastened, but not welded) together in the place where it will stand. Such structures as are provided by the present invention may be dis-assembled at a later time; a feature which would be substantially impossible with a welded structure. Moreover, a structure which is assembled according to the present invention, especially when made with glass-coated steel and approved mastic or other sealant, may be used for potable water without additional treatment, and without the necessity for occasional cleaning or other repair, as would be necessary for a non-glass lined tank.

Storage towers of great height can be constructed according to the present invention; and where glass-coated plates are used, there is considerable sticktion between the plates, so that the structure is very secure.

When very tall water towers are built with the overlapped plates as described, the higher water pressure at the bottom of the tower can cause the plates to shift slightly.

The plates in the tower abut one against another. For example, the plate 38 abuts the plate 36. Since the edges never quite touch, the resulting gap can be a potential leak path, as shown by the arrows 46,47.

This potential leakpath is blocked by jointing compound which is normally quite adequate to seal off the leakpath.

However, especially when the plates are glass-coated, it may be necessary to leave the bolts not quite tight, to avoid cracking the glass. What can happen therefore is that when the tower is filled with water the plates can shift or settle to a slightly different fit relatively one to another. This is especially so at the bottom of the tower where the pressure of the water is highest.

Inevitably, this settling of the plates has the result that the potential leakpath at an abutment gap, such as that at 46,47, becomes wider, within the limits permitted by whatever clearance there is between the bolts and bolt holes. It may be that such a gap widens say 1 mm.

The kind of jointing compound used is extremely sticky and stretchy. However, if some of the plates should be virtualy in abutment contact, then the bead of compound is very thin; and it those plates then move apart a distance of 1 mm, it can happen that the stickiness and stretchiness of the bead is not enough that the bead can cope with the disruption, with the result that the bead breaks away from one of the plates. Since the breakaway, if it happens, can occur along the full length of the path 46,47 a leak can therefore occur.

The purpose of the development of the invention is to provide a cure for the above problem.

The development comprises providing a means to prise the abutting plates apart to their fullest extent before the jointing compound has set. Therefore, the potential leakpaths are at the widest they can ever be at the time when the jointing compound sets. So, when the water is put in, the gaps cannot widen any further.

The means to pry the plates apart can comprise a jack which is secured to the rows of bolts either side of the gap in question. The columns of bolts alongside the gap are left loose. When the jack is extended it picks up on the bolts in the horizontal rows, which are drawn apart, so pulling the plates apart. The bolts in the vertical columns can then be tightened.

Preferably, all the joints in one ring of plates right around the tower would be prised apart at the same time, so that as many jacks are needed as there are plates in a ring.

Figure 6:
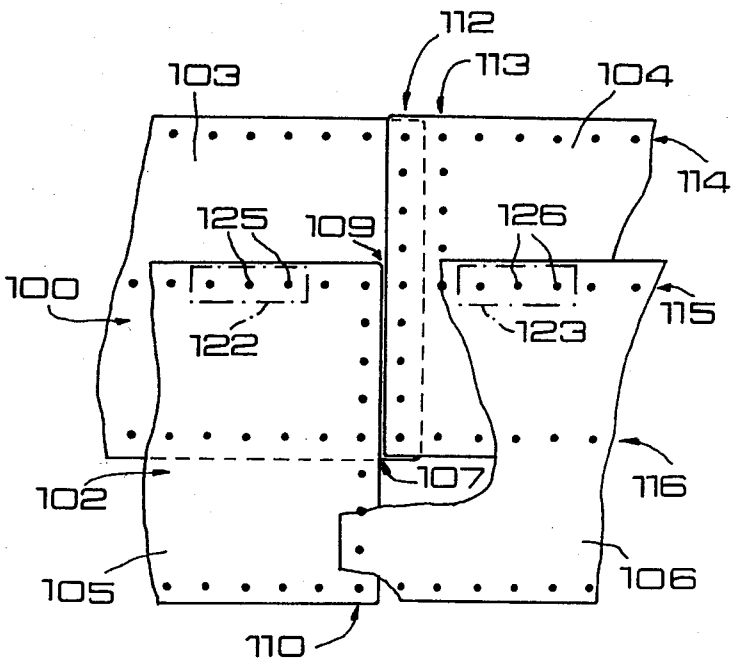
FIG. 6 is an elevation of part of a water storage tower.
Figure 7:
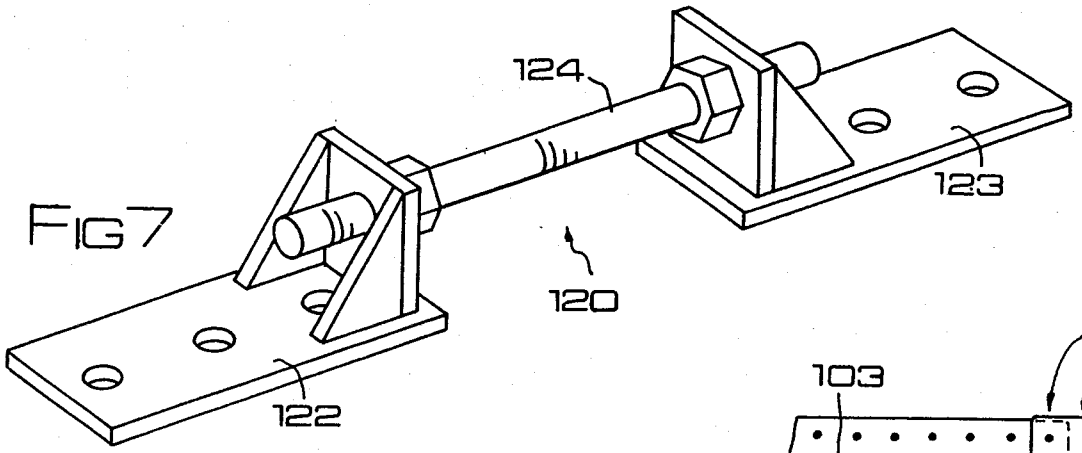
FIG. 7 is a view of a jack.

The development of the invention is further described with reference to the accompanying drawings, in which:

FIG. 6 is an elevation of part of a water storage tower;

FIG. 7 is a view of a jack.

To assemble the tower, plates are arranged in a row to form a complete ring. This ring is jacked up using conventional lifting jacks as mentioned above, and another ring arranged beneath it. Then the two rings are raised together, and a third ring arranged below, as previously described.

In FIG. 6, two such rows of plates which make up a ring are illustrated at 100,102. Plates 103,104 are in the upper 100 of these two rings, and plates 105,106 are in the lower ring 102. The ring 102 rests on the foundation of the tower, ready to be raised in its turn.

The plates 104,105 are in edge-abutment, and a potential leak-path is created at the gap indicated by the arrows 107,109.

The rows and columns of bolts are as indicated in FIG. 6 by the numerals 110–116; 110,112,113 being vertical columns, bolts 114,115,116 being horizontal rows of bolts.

All the bolts in the rows 114,115,116 are tightened, except that all the bolts in the columns 110,112 are left loose, including the bolts in those columns that also happen to be in the rows 114,115,116.

It will be appreciated that with the bolts in this state, the gap 107,109 may be increased or decreased, within the slack permitted by the fit of the bolts in the bolt-holes. The gap may be increased by pressing the plates outwards from inside the ring: the gap may, if required, be made wider at the bottom than at the top by pressing outwards from inside at, say, the level of the row 116, whilst pressing the ring inwards at the level of the row 115.

A more convenient manner of opening the gaps however is to use jacks. One of these is shown as to its location in FIG. 6 and as to its (very simple) construction in FIG. 7. The jack 120 has two pads 122,123 each with bolt holes. A screw 124 is provided for the purposse of enabling the pads to be forced apart.

The nuts are removed from the bolts that occupy the holes 125,126. The pads 122,123 are slipped over the protruding ends of the bolts, and the nuts are replaced and re-tightened.

The screw 124 is used to force the pads apart. Since all the bolts in row 115 are tight, except those that are also in columns 110,112, this action causes the gap 107,109 to increase to its maximum extent.

Similar jacks are similarly applied to all the other edge-abutment locations around the ring 100. After all the top ends 109 of the gaps have been widened, the bolts in row 115 that were loose (i.e., those also in columns 110,112) are tightened.

The pads are removed from the row 115, the nuts being replaced and re-tightened on the bolts. The pads are moved down to row 116 and the same procedure is repeated, this time to ensure that the bottom ends 107 of the gaps are widened.

Jointing compound is injected into the gap 107,109. The bolts in columns 110,112 now are tightened, but they need be tightened only sufficiently to give a good seal. The above procedure ensures that the gap 107,109 cannot change under the effect of water pressure.

What is claimed is:

1. A method of building a cylindrical storage vessel from a plurality of flangeless plates, which comprises the following steps:

(a) providing a foundation plinth of concrete cast into a first ring of steel plates having inner and outer surfaces;

(b) forming on the plinth a second row of rectangular steel plates, each having respective upper margins, lower margins, and right-hand and left-hand edges and edge margins, and inner and outer surfaces, into a continuous ring by overlapping and bolting together right-hand and left-hand edge margins, respectively, of adjacent plates so as to have surface to surface contact in the overlapped region between adjacent pairs of plates;

(c) raising said second ring just formed using lifting jacks, and similarly forming on the plinth a further row of similar rectangular steel plates into a continuous ring;

(d) said second and all further rings of plates being raised in such a manner that the upper margins of the plates in a lower ring overlap the lower margins of the plates in a next successive higher ring of plates; so as to have surface to surface contact in the overlapped region between adjacent rings of plates;

(e) positioning said second and all further rings of plates so that the plates in each ring are staggered with respect to the plates in the next successive higher ring of plates so that an upper portion of one side edge of each of said plates in a first ring of plates is in direct edge to edge abutment with a lower portion of the opposite side edge of each of said plates in the next successive higher ring of plates respectively;

(f) bolting all of said overlapped regions together; and (g) repeating steps (c) to (f) until the required number of rings of plates have been formed and assembled one to another; and wherein:

in step (d), and for at least two adjacent lower and higher rings of plates, said adjacent rings are so positioned that the extent of the surface to surface contact between the upper margins of the plates of the lower ring of said at least two adjacent rings of plates and of the lower margins of the higher ring of said at least two adjacent rings of plates is more than half of the vertical height of each of said plates.

2. The method of claim 1, wherein a reinforcing ring is bolted with surface to surface contact and sideways overlap in the same manner as said second and all further rings of plates, and said reinforcing ring is bolted to said first ring of steel plates over the outer surface thereof in at least a middle portion thereof so as to be above and below the top of said plinth.

3. The method of claim 1, comprising also the following steps:

(h) ensuring that, of the bolts that hold adjacent pairs of plates each to the other, where a first one of each of said adjacent pairs of plates is in a first ring of plates, and a second one of each of said adjacent pairs of plates is in the next successive higher ring of plates, and said adjacent pair of plates are in edge to edge abutment, all as set forth in step (e), that enough of the bolts are, though present, loose enough to permit one of said adjacent pair of plate to move with respect to the other of said adjacent pair of plates so that any clearance of the bolts in their respective holes is taken up;

(i) placing a spreading jack means in operative engagement between the plates of an adjacent pair of plates, as defined;

(j) spreading the plates of said adjacent pair of plates substantially to a fullest extent permitted by said clearance of said bolts in their respective holes, such that said portions of the edges of said plates of said adjacent pair of plates that were in edge to edge abutting relationship are spread apart so as to create a gap between said abutting portions;

(k) tightening said bolts, so as to hold said plates in spread apart relationship; and (l) placing sufficient sealant in said gap so as to fill the gap.

4. Method of claim 3, where said spreading jacks means is a screw jack having pads which are secured respectively to each of the plates of an adjacent pair of plates, as defined.

5. Method of claim 4, where as many jacks are provided as there are plates in a ring, so that all the plates in that ring may be are spread apart simultaneously from the respective adjacent plates of all of the adjacent pairs in said next successive higher ring of plates.

* * * * *